US009805524B2

(12) United States Patent
Sukumaran et al.

(10) Patent No.: US 9,805,524 B2
(45) Date of Patent: Oct. 31, 2017

(54) SYSTEMS AND METHODS FOR DISPLAYING A FAULT ANALYSIS INSTRUCTIONS OF AN ENGINE CONTROL SUBSYSTEM

(71) Applicant: General Electric Company, Schenectady, NY (US)

(72) Inventors: Suseel Sukumaran, Bangalore (IN); Mayank Gupta, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/067,490

(22) Filed: Mar. 11, 2016

(65) Prior Publication Data

US 2017/0263060 A1 Sep. 14, 2017

(51) Int. Cl.

| | |
|---|---|
| ***G07C 5/08*** | (2006.01) |
| ***G07C 5/00*** | (2006.01) |
| ***G07C 3/00*** | (2006.01) |

(52) U.S. Cl.

CPC ..... *G07C 5/0808* (2013.01); *G07C 5/006* (2013.01); *G07C 5/008* (2013.01); *G07C 5/0825* (2013.01)

(58) Field of Classification Search

None

See application file for complete search history.

(56) References Cited

U.S. PATENT DOCUMENTS

| | | | | |
|---|---|---|---|---|
| 5,453,939 | A * | 9/1995 | Hoffman | B60K 35/00 340/438 |
| 5,491,631 | A * | 2/1996 | Shirane | F02D 41/22 123/479 |
| 6,100,792 | A * | 8/2000 | Ogino | B60R 25/1001 340/12.54 |
| 7,000,590 | B2 | 2/2006 | Carlton et al. | |
| 7,765,039 | B1 * | 7/2010 | Hagenbuch | G07C 5/008 340/436 |
| 7,826,943 | B2 * | 11/2010 | Yu | G05B 23/0232 701/31.2 |

(Continued)

FOREIGN PATENT DOCUMENTS

| | | | |
|---|---|---|---|
| EP | 1531247 | A2 | 5/2005 |
| WO | 2006088768 | A2 | 8/2006 |
| WO | 2012016155 | A1 | 2/2012 |

*Primary Examiner* — Krishnan Ramesh

(74) *Attorney, Agent, or Firm* — Global Patent Operation; John A. Kramer

(57) ABSTRACT

A system includes one or more sensors that generate sensor measurement signals based on characteristics of one or more components of an engine control subsystem. The system also includes a controller circuit having one or more processors. The controller circuit is programmed to perform operations in response to instructions stored on a non-transitory memory. The operations performed by the controller circuit include acquiring the sensor measurement signals from the one or more sensors. The sensor measurement signals include electrical characteristics. The operations performed also include comparing the electrical characteristics of the sensor measurement signals with operational threshold corresponding to the one or more sensors, determining a set of candidate sensors having a fault based on the comparison, and displaying a troubleshoot window based on a select candidate sensor.

18 Claims, 8 Drawing Sheets

(56) References Cited

U.S. PATENT DOCUMENTS

| | | | | |
|---|---|---|---|---|
| 8,738,326 | B2 * | 5/2014 | Gurijala | G05B 23/0294 701/100 |
| 9,201,409 | B2 * | 12/2015 | Kumar | B61L 3/006 |
| 2004/0016804 | A1 * | 1/2004 | Namaky | G07C 5/0816 235/435 |
| 2006/0000442 | A1 | 1/2006 | Carlton et al. | |
| 2006/0184295 | A1 | 8/2006 | Hawkins et al. | |
| 2008/0243328 | A1 * | 10/2008 | Yu | G05B 23/0232 701/31.2 |
| 2008/0319602 | A1 * | 12/2008 | McClellan | G07C 5/008 701/31.4 |
| 2011/0257869 | A1 | 10/2011 | Kumar et al. | |
| 2013/0213344 | A1 | 8/2013 | Stender | |
| 2014/0125489 | A1 * | 5/2014 | Heckford | H04L 67/12 340/870.01 |
| 2015/0137993 | A1 | 5/2015 | Terry | |
| 2015/0206104 | A1 * | 7/2015 | Suzuki | G06Q 50/10 705/305 |

* cited by examiner

SYSTEMS AND METHODS FOR DISPLAYING A FAULT ANALYSIS INSTRUCTIONS OF AN ENGINE CONTROL SUBSYSTEM

FIELD

Embodiments of the subject matter disclosed herein relate to engine control systems.

BACKGROUND

Engine control systems perform various complex functions for vehicle systems. These functions may include safety, input/output signal processing logic, engine control, alarm functionality, and/or the like. During operation of the powered vehicle, system errors or malfunctions occur triggering one or more fault alarms. To correct the error or malfunction, operators will refer to a hard copy fault manual. The hard copy manual lists fault alarms with a corresponding check list for the operator. The operator may perform the steps on the checklist to correct the malfunction. However, currently available hard copy manual check lists are limited without providing detailed steps on how to correct the malfunction. Additionally, the hard copy manual can be misplaced, damaged over time, and/or out of date. Thus, a need exists for systems and methods for improved fault analysis.

BRIEF DESCRIPTION

In one embodiment, a system includes one or more sensors that are configured to generate sensor measurement signals based on characteristics of one or more components of an engine control subsystem. The system also includes a controller circuit. The controller circuit includes one or more processors. The controller circuit is programmed to perform operations in response to instructions stored on a non-transitory memory. The operations performed by the controller circuit include acquiring the sensor measurement signals from the one or more sensors. The sensor measurement signals include electrical characteristics. The operations performed include comparing the electrical characteristics of the sensor measurement signals with operational threshold corresponding to the one or more sensors, determining a set of candidate sensors having a fault based on the comparison, and displaying a troubleshoot window based on a select one of the candidate sensors.

In one embodiment, a method (e.g., for engine system sensor fault analysis) includes acquiring characteristic data associated with one or more components of an engine control subsystem. The characteristic data is based on a plurality of sensor measurement signals generated from one or more sensors. The method includes comparing electrical characteristics of the sensor measurement signals with operational thresholds corresponding to the one or more sensors, determining a set of candidate sensors having a fault based on the comparison, and displaying a troubleshoot window based on a select one of the candidate sensors.

In one embodiment, a tangible and non-transitory computer readable medium includes one or more computer software modules configured to direct one or more processors to acquire characteristic data for one or more components of an engine control subsystem. The characteristic data is based on a plurality of sensor measurement signals generated from one or more sensors. The one or more processors may further be directed to compare electrical characteristics of the sensor measurement signals with operational thresholds corresponding to the one or more sensors, determine a set of candidate sensors having a fault based on the comparison, and display a troubleshoot window based on a select candidate sensor of the set of candidate sensors.

BRIEF DESCRIPTION OF THE DRAWINGS

The present inventive subject matter will be better understood from reading the following description of non-limiting embodiments, with reference to the attached drawings, in which.

DETAILED DESCRIPTION

Various embodiments described herein provide troubleshooting instructions as a part of a graphical user interface (GUI), such as a computational functional display (CFD), shown on a display. The CFD described herein provides a human machine interface or operator controller input device for viewing, diagnosing, and troubleshooting fault/errors for a powered system. The CFD may be configured to display troubleshooting instructions when invoked by an operator of a powered system (e.g., a vehicle system, marine vessel, generator system, stationary power control system, and/or the like) for one or more selected fault/errors displayed on the CFD. When a specific fault/error is detected, the fault/error is logged and displayed on the CFD within a troubleshoot window of the CFD that includes instructions to resolve or diagnose the corresponding fault/error. Additionally or alternatively, the troubleshoot window may correspond to a system feature that is activated by a manufacturer and/or remotely.

The troubleshoot window may include details about the fault/error, conditions under which the fault/error will be cleared, locations of the sensor having the fault, instructions on how the operator may troubleshoot the fault, and/or the like. The details about the fault/error may include when the fault/error was logged, conditions that caused the fault/error, threshold/limits corresponding to the fault/error, and/or the like. The troubleshooting instructions may include instructions for the operator based on the sensor having detected the fault. For example, the troubleshooting instructions may include details on the sensor wirings, typical voltages, connections to other components, and/or the like.

At least one technical effect of various embodiments described herein may include reducing the effort required by the operator to troubleshoot a detected fault/error. At least one technical effect of various embodiments described herein may include availability of troubleshooting instructions and/or fault analysis manuals without being misplaced and/or damaged over time. At least one technical effect of various embodiments described herein may include availability of up-to-date troubleshooting instructions and/or fault analysis manuals in case the fault/error conditions are changed/updated.

Figure 1:
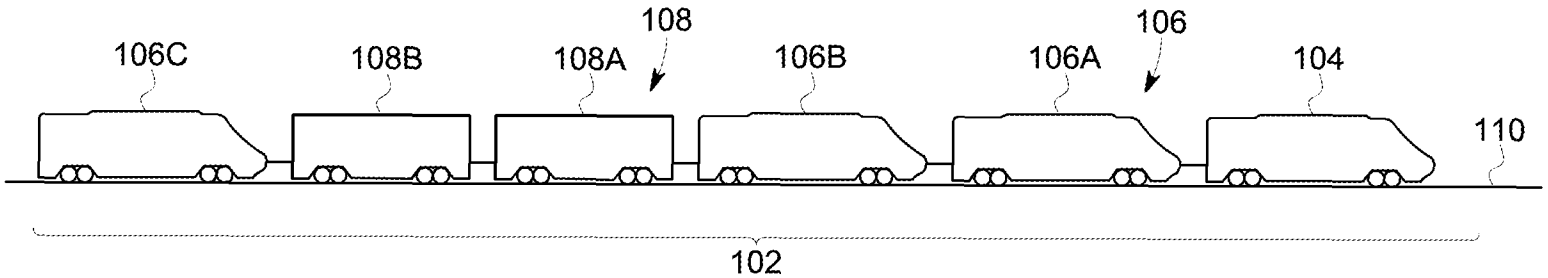
FIG. 1 illustrates a vehicle system, in accordance with an embodiment.

FIG. 1 illustrates one embodiment of a vehicle system 102. The illustrated vehicle system 102 includes propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles 104, 106, 108 are shown as being mechanically coupled with each other, optionally, the vehicles 104, 106, 108 may not be mechanically coupled with each other.

Figure 8:
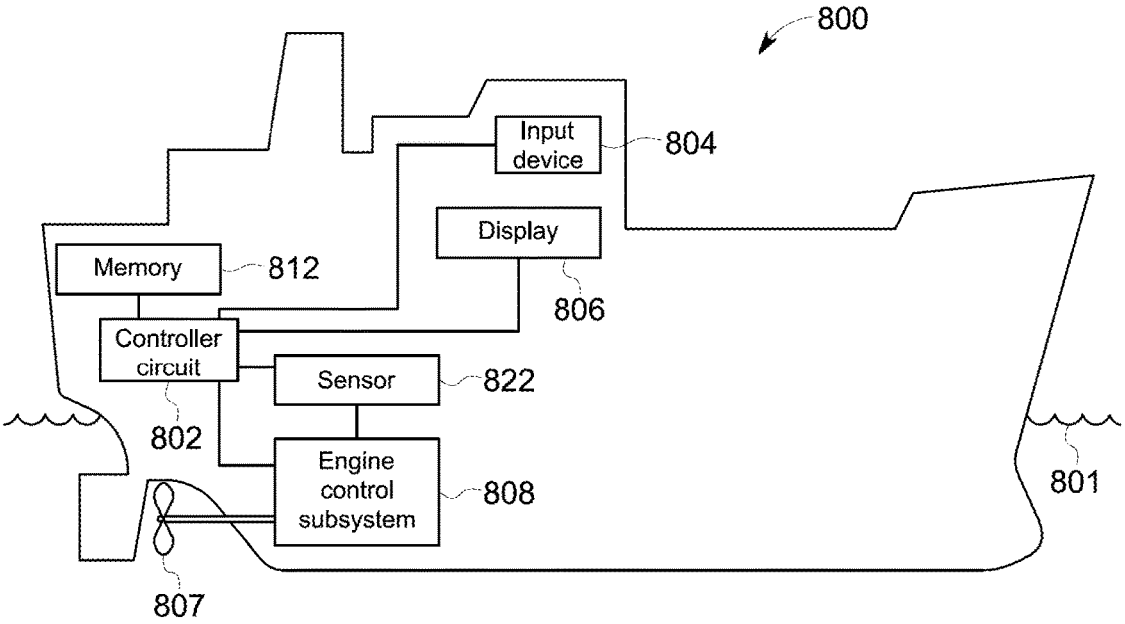
FIG. 8 is a schematic diagram of a vehicle system, in accordance with an embodiment.

The propulsion-generating vehicles 104, 106 are shown as locomotives, the non-propulsion-generating vehicles 108 are shown as rail cars, and the vehicle system 102 is shown as a train in the illustrated embodiment. It may be noted that in other embodiments, the vehicles 104, 106 may represent other vehicles, such as automobiles, marine vessels (e.g., as shown in FIG. 8), airplanes, and/or the like. Optionally, the vehicle system 102 can represent a grouping or coupling of these other vehicles. The number and arrangement of the vehicles 104, 106, 108 in the vehicle system 102 are provided as one example and are not intended as limitations on all embodiments of the subject matter described herein.

Optionally, groups of one or more adjacent or neighboring propulsion-generating vehicles 104 and/or 106 may be referred to as a vehicle consist. For example the vehicles 104, 106A, 106B may be referred to as a first vehicle consist of the vehicle system 102 and the vehicle 106C referred to as a second vehicle consist of the vehicle system 102. Alternatively, the vehicle consists may be defined as the vehicles that are adjacent or neighboring to each other, such as a vehicle consist defined by the vehicles 104, 106A, 106B, 108A, 108B, 106C.

The propulsion-generating vehicles 104, 106 may be arranged in a distributed power (DP) arrangement. For example, the propulsion-generating vehicles 104, 106 can include a lead vehicle 104 that issues command messages to the other propulsion-generating vehicles 106A, 106B, 106C which are referred to herein as remote vehicles. The designations "lead" and "remote" are not intended to denote spatial locations of the propulsion-generating vehicles 104, 106 in the vehicle system 102, but instead are used to indicate which propulsion-generating vehicle 104, 106 is communicating (e.g., transmitting, broadcasting, or a combination of transmitting and broadcasting) command messages and which propulsion-generating vehicles 104, 106 are being remotely controlled using the command messages. For example, the lead vehicle 104 may or may not be disposed at the front end of the vehicle system 102 (e.g., along a direction of travel of the vehicle system 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or non-propulsion-generating vehicles 108.

Figure 2:
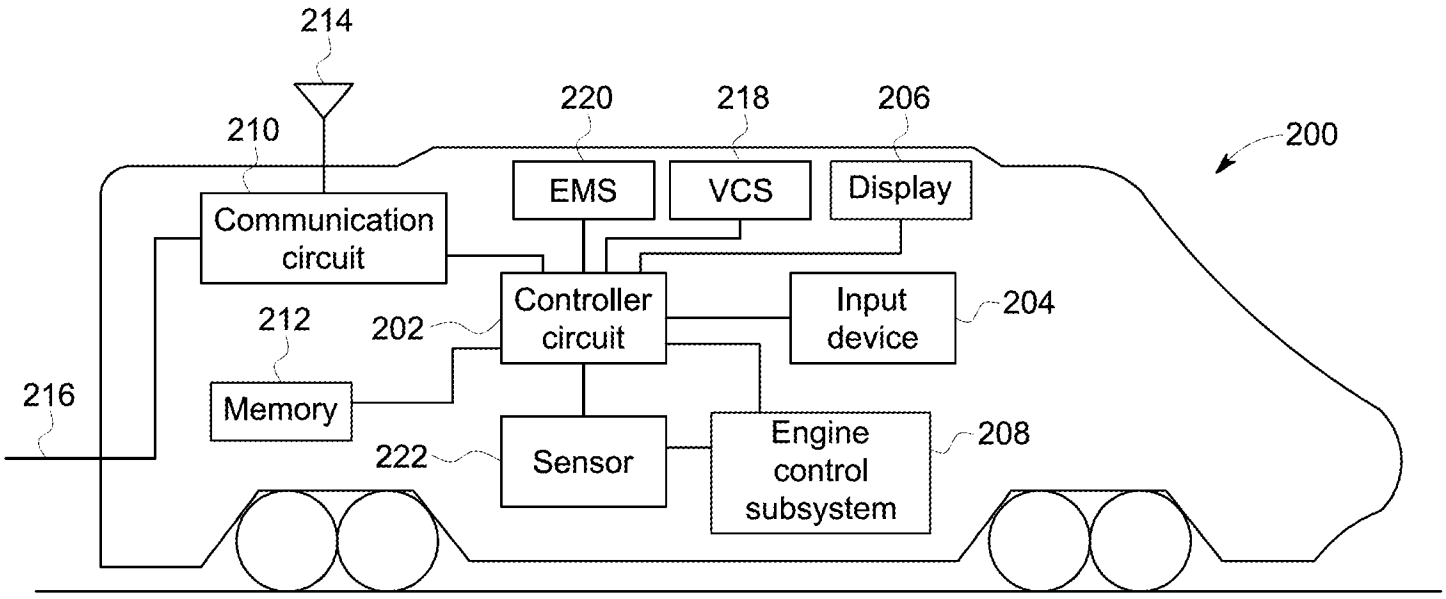
FIG. 2 is a schematic diagram of a propulsion-generating vehicle, in accordance with an embodiment.

FIG. 2 is a schematic diagram of a propulsion-generating vehicle 200, in accordance with one embodiment. The vehicle 200 may represent one or more of the vehicles 104, 106 shown in FIG. 1. The vehicle 200 includes a controller circuit 202 that controls operations of the vehicle 200. The controller circuit 202 may include or represent one or more hardware circuits or circuitry that include, are connected with, or that both include and are connected with one or more processors, controllers, or other hardware logic-based devices.

The controller circuit 202 may be connected with a communication circuit 210. The communication circuit 210 may represents hardware and/or software that is used to communicate with other vehicles (e.g., the vehicles 104-108) within the vehicle system 102, dispatch stations, remote system, and/or the like. For example, the communication circuit 210 may include a transceiver and associated circuitry (e.g., antennas) 214 for wirelessly communicating (e.g., communicating and/or receiving) linking messages, command messages, linking confirmation messages, reply messages, retry messages, repeat messages, status messages, and/or the like. Optionally, the communication circuit 210 includes circuitry for communicating the messages over a wired connection 216, such as a multiple unit (MU) line of the vehicle system 102, catenary or third rail of an electrically powered vehicle, or another conductive pathway between or among the propulsion-generating vehicles 104, 106, 400 in the vehicle system 102.

A memory 212 may be may be used for storing data associated with the one or more sensors 222 (e.g., operational threshold values, location information), fault information (e.g., when a fault was identified, conditions and/or reason for the fault), troubleshoot information corresponding to one or more faults, firmware or software corresponding to, for example, a graphical user interface, programmed instructions for one or more components in the propulsion-generating vehicle 200 (e.g., the controller circuit 202, an engine control subsystem 208, an energy management subsystem 220, a vehicle control subsystem 218, and/or the like). The memory 212 may be a tangible and non-transitory computer readable medium such as flash memory, RAM, ROM, EEPROM, and/or the like.

The controller circuit 202 is connected with an engine control subsystem 208. The engine control subsystem 208 provides tractive effort and/or braking effort of the propulsion-generating vehicle 200. The engine control subsystem 208 may include or represent one or more engines, motors, alternators, generators, brakes, batteries, turbines, and/or the like, that operate to propel the propulsion-generating vehicle 200 under the manual or autonomous control that is implemented by the controller circuit 202. For example, the controller circuit 202 can generate control signals autonomously and/or based on manual input that is used to direct operations of the engine control subsystem 208.

One or more sensors 222 may monitor one or more components of the engine control subsystem 208 by acquiring characteristic data (e.g., temperature data, humidity data, pressure data, volume data, oxidation data) of the components during operation of the vehicle system 102. Optionally, the one or more sensors 222 may be a part of the engine control subsystem 208. Additionally or alternatively, the one or more sensors 222 may be electrical coupled to one or more components of the engine control subsystem 208. The components of the engine control subsystem 208 may include a radiator, coolant, fuel tank, exhaust, intake, shaft, axle, air pump, fuel pump, water pump, pipe, and/or the like. The one or more sensors 222 may include pressure sensors (e.g., sea water pressure sensor), ultrasonic sensors, humidity sensors, magnetic sensors (e.g., hall effect sensors), speed sensors, gas sensors (e.g., oxygen sensor), temperature sensors (e.g., water temperature inlet/outlet sensor, engine coolant sensor, radiator temperature sensor), and/or the like. Optionally, the one or more sensors 222 may monitor the external environment of the propulsion-generating vehicle 200. For example, the one or more sensors 222 may include proximity sensors, visual sensors, speed sensors, temperature sensors, and/or the like.

Each of the one or more sensors 222 may generate a sensor measurement signal, which is received and/or acquired by the controller circuit 202. The sensor measurement signals include one or more electrical characteristics representing the characteristic data acquired by the one or more sensors 222. Based on the one or more electrical characteristics of the sensor measurement signal (e.g., amplitude, voltage, current, frequency), the controller circuit 202 may determine if possible malfunctions are occurring during operation of the engine control subsystem 208 and/or the propulsion-generating vehicle 200. The malfunctions may indicate a breakdown or failure of a component of the engine control subsystem 208 that may decrease a usable life-cycle or life expectancy of the component. In one aspect, the one or more sensor 222 may monitor the components of the engine control subsystem 208 to protect the operation of the engine control subsystem 208.

Additionally, the sensor measurement signal may indicate a fault of the one or more sensors 222. For example, the sensor measurement signals may be outside one or more operational thresholds of the one or more sensors 222. In various embodiments, each of the one or more sensors 222 may have a corresponding operational threshold stored on the memory 212. The one or more operational thresholds may be based on predetermined or designated characteristics of the one or more sensors 222, corresponding component measured by the one or more sensors 222, and/or the like. Based on the one or more electrical characteristics of the sensor measurement signal (e.g., amplitude, voltage, current, frequency) with respect to the one or more operational thresholds, the controller circuit 202 may determine if possible faults are occurring during operation of the engine control subsystem 208 and/or the propulsion-generating vehicle 200. A fault may correspond to an abnormal condition or defect of the one or more sensors 222. The fault may occur due to wear or deterioration of the one or more sensors 222, defects and/or flaws in connections (e.g., physical, electrical, and/or the like) of the one or more sensors 222 with other components within the engine control subsystem 208 and/or the controller circuit 202, error in manufacturing or specification of the one or more sensors 222, and/or the like. When a fault is detected, the controller circuit 202 may identify the fault/error and display a notification on a display 206. For example, the controller circuit 202 may identify whether a fault corresponds to a set of the one or more sensors 222 by comparing the one or more electrical characteristics to the one or more operational thresholds stored on memory 212. It may be noted, at least a portion of the one or more sensors 222 forming the set may transmit a fault signal to the controller circuit 202.

The controller circuit 202 is connected to an input device 204 and the display 206. The controller circuit 202 can receive manual input from an operator of the propulsion-generating vehicle 200 through the input device 204, such as a keyboard, touchscreen, electronic mouse, microphone, or the like. For example, the controller circuit 202 can receive manually input changes to the tractive effort, braking effort, speed, power output, and the like, from the input device 204.

The display 206 may include one or more liquid crystal displays (e.g., light emitting diode (LED) backlight), organic light emitting diode (OLED) displays, plasma displays, CRT displays, and/or the like. For example, the controller circuit 202 can present the status and/or details of the vehicle system 102, faults/alarms based on the sensor measurement signals generated by the one or more sensors 222, identities and statuses of the remote vehicles 106, contents of one or more command messages, and/or the like. Optionally, the display 204 may be a touchscreen display, which includes at least a portion of the input device 204.

A portion of the input device 204 may interact with a graphical user interface (GUI) generated by the controller circuit 202, which is shown on the display 204. In connection with FIG. 3, the GUI may be a computational functional display (CFD) 300.

Figure 3:
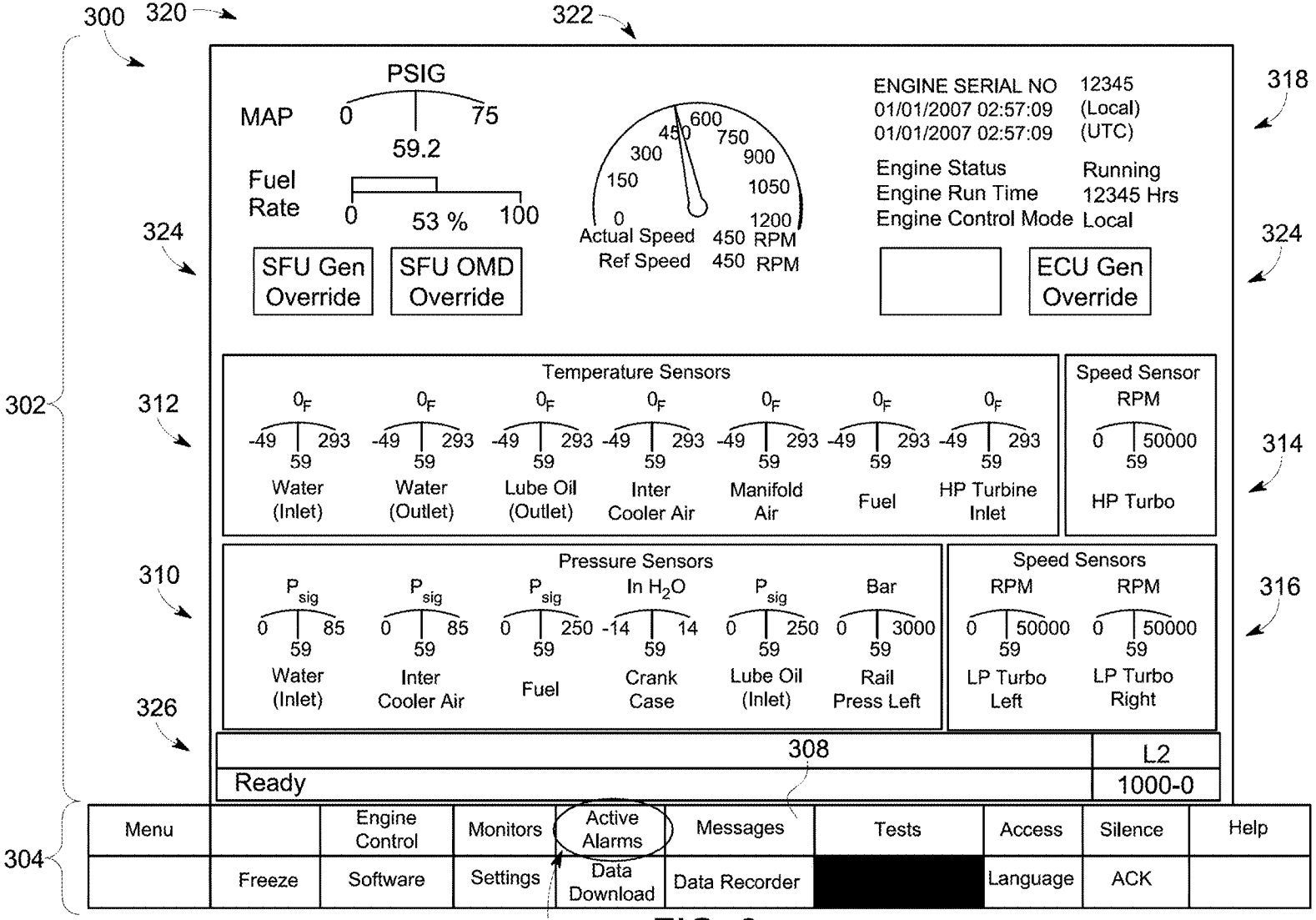
FIG. 3 is an illustration of a computational functional display shown on a display of the propulsion-generating vehicle in FIG. 2.

FIG. 3 is an illustration of the CFD 300 shown on the display 206 of the propulsion-generating vehicle 200. The CFD 300 is shown with an indicator region 302 and an operation menu 304. The indicator region 302 may display information associated with an operational status of the propulsion-generating vehicle 200 and/or vehicle system 102. The indicator region 302 may include one or more operation indicators such as gauges, meters, numerical values, warning indicators 324, an operation information window 318, graphical indicators, and/or the like. For example, the operation information window 318 may include time information, operational modes of the propulsion-generating vehicle 200, and/or the like. The indicator region 302 may further include navigational and efficiency indicators 320 that display information related to running efficiency of the propulsion-generating vehicle 200. For example, the navigational and efficiency indicators 320 may include a fuel rate meter, a load gauge, and/or the like. Additionally or alternatively, the indicator region 302 may include a speedometer 322.

In the illustrated embodiment of FIG. 3, a portion of the operation indicators shown in the indicator region 302 may be grouped into one or more windows 310-316 corresponding to a type of characteristic (e.g., temperature, speed, pressure) measured by the one or more sensors 222. For example, the indicator region 302 may include a pressure window 310, a temperature window 312, speed windows 314-316, and/or the like. Each of the illustrated windows 310-316 include one or more gauges corresponding to different components measured by the one or more sensors 222. Optionally, the operator may move a position of one or more of the windows 310-316 shown in the indicator region 302 using the input device 204. Additionally or alternatively, the operator may change and/or add a characteristic window shown in the indicator region 302 and/or change components represented by the gauges included in the windows 310-316 by using the input device 204.

The operation menu 304 of the CFD 300 may include one or more interface components (e.g., 306, 308) that may be selected, manipulated, and/or activated by the operator operating the input device 204 (e.g., touch screen, keyboard, mouse). For example, the operator may select the interface component 308 to access messages received from the communication circuit 210. The interface components may be presented in varying shapes and colors, such as a graphical or selectable icon, a slide bar, a cursor, and/or the like. Optionally, one or more interface components may include text or symbols. It may be noted that in other embodiments the operation menu 304 may be a toolbar, a drop down menu, and/or the like. Additionally or alternatively, one or more interface components may indicate areas within the CFD 300 for entering or editing information (e.g., destination of the vehicle system 102, commend messages), such as a text box 326, a text field, and/or the like.

Figure 4:
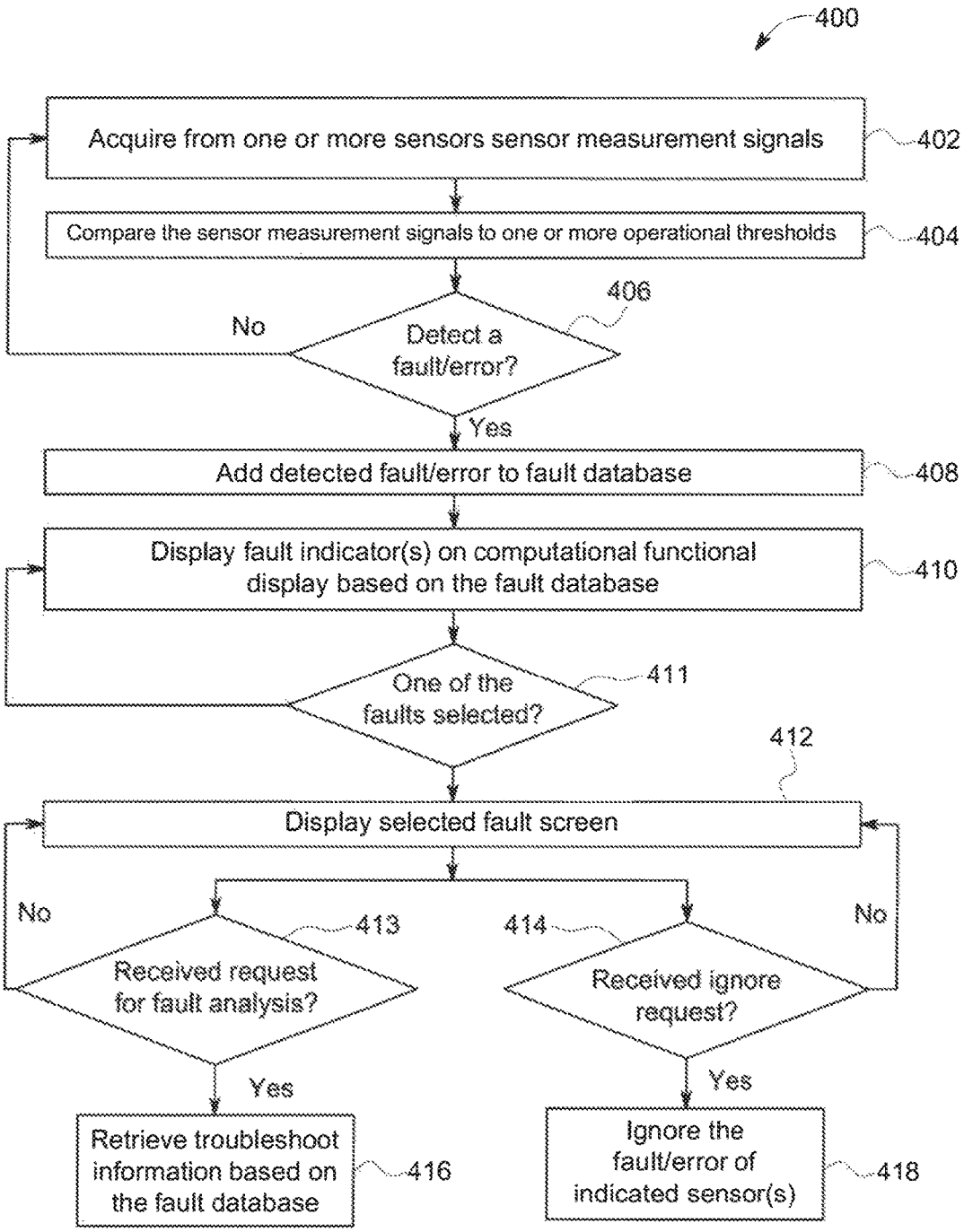
FIG. 4 is a flowchart of a method for displaying an engine control fault analysis, in accordance with an embodiment.

In connection with FIG. 4, the operator may select one or more interface components of the CFD to view troubleshoot instructions for one or more faults/errors detected by the controller circuit 202.

FIG. 4 is a flowchart of a method 400 for displaying a fault analysis of the engine control subsystem 208. The fault analysis includes troubleshoot information based on the fault/error detected by the controller circuit 202. The method 400, for example, may employ or be performed by structures or aspects of various embodiments (e.g., systems and/or methods) discussed herein. In various embodiments, certain operations may be omitted or added, certain operations may be combined, certain operations may be performed simultaneously, certain operations may be performed concurrently, certain operations may be split into multiple operations, certain operations may be performed in a different order, or certain operations or series of operations may be re-performed in an iterative fashion. In various embodiments, portions, aspects, and/or variations of the method 400 may be able to be used as one or more algorithms to direct hardware to perform one or more operations described herein.

One or more methods may (i) acquire sensor measurement signals, (ii) compare the sensor measurement signals with operational threshold corresponding to the one or more sensors, (iii) determine a set of candidate sensors having a fault based on the operational thresholds, and (iv) display a troubleshoot window based on a select candidate sensor.

At 402, the controller circuit 202 may acquire from one or more sensors 222 sensor measurement signals. In various embodiments, the sensor measurement signals may be based characteristic data of one or more components of the engine control subsystem 208 measured by the one or more sensors 222. For example, the one or more sensors 222 may measure one or more characteristics (e.g., temperature, pressure, humidity, volume, oxidation) of the one or more components of the engine control subsystem 208. The components of the engine control subsystem 208 may include a radiator, coolant, fuel, exhaust, one or more intakes, shaft, axle, and/or the like. Based on the measurement of the one or more characteristics, the one or more sensors 222 may generate the sensor measurement signals having electrical characteristics (e.g., amplitude, frequency, pulse width, voltage, current) corresponding to the one or more measured characteristics. For example, the one or more sensors 222 may be a water inlet temperature sensor that measures a temperature of a water inlet for the engine control subsystem 208. The water inlet temperature sensor may generate a sensor measurement signal having an amplitude based on the temperature of the water inlet. It may be noted that in other embodiments, the sensor measurement signal may correspond to a digital signal such as a data packet, a bit value, and/or the like generated by the one or more sensors 222.

The sensor measurement signals generated by the one or more sensors 222 may be acquired by the controller circuit 202 as characteristic data of the engine control subsystem 208. Based on the electrical characteristics of the sensor measurement signals, the controller circuit 202 may determine the characteristics of the one or more components of the engine control subsystem 208. For example, the controller circuit 202 may generate one or more gauges based on the characteristic data (e.g., the speedometer 322), which may be shown on the CFD 300.

At 404, the controller circuit 202 may compare the sensor measurement signals to one or more operational thresholds. The one or more operational thresholds may be stored on the memory 212. Each operational thresholds may have a corresponding sensor 222. For example, each sensor 222 will have a corresponding operational threshold stored on the memory 212. The one or more operational thresholds may be based on predetermined or designed characteristics of the one or more sensors 222. For example, when one or more sensors 222 is outside and/or not within the operational threshold the corresponding one or more sensors 222 may be in fault and/or error. Additionally or alternatively, the one or more operational thresholds may be a set of ranges, bandwidths, and/or peak values of electrical characteristics. The operational thresholds may define and/or be utilized by the controller circuit 202 to determine when the one or more sensors 222 are in fault and/or a malfunction is occurring when measuring characteristics of the components during operation of the engine control subsystem 208.

For example, the sensor measurement signals may be changed during transit or transmission by the connections (e.g., physical, electrical, and/or the like), such as a short, between the one or more sensors 222 and the controller circuit 202, prior to the sensor measurement signals arriving at the controller circuit 202, and/or the like. In another example, due to wear or deterioration of the one or more sensors 222 the measured characteristics may be adjusted or changed outside of a realistic characteristic (e.g., orders of magnitude above operating parameters or specification) of the corresponding component of the engine control subsystem 208.

The one or more operational thresholds may correspond to voltages, currents, and/or frequency values relating to one or more electrical characteristics of different sensor measurement signals received by the controller circuit 202. Additionally or alternatively, the one or more operational thresholds may change or is adjusted based on or a function of the operation (e.g., of the vehicle system 102 or characteristic of one or more components of the engine control subsystem 208. For example, at least a subset of the one or more operational thresholds may be adjusted based on a speed, age, temperature (e.g., external, internal), size, and/or the like of one or more components (e.g., one or more engines, motors, alternators, generators, brakes, batteries, turbines, and/or the like) of the engine control system 208 measured by the corresponding sensor 222 or an alternative sensor 222. For example, one of the one or more operational threshold may correspond to an oil pressure, which is adjusted based on a speed of the vehicle system 102 or rotations per minute of an engine of the engine control subsystem 208 measured by another sensor. For example, when the speed of the vehicle system 102 increases, the operation threshold of a corresponding sensor 222 acquiring characteristics corresponding to the oil pressure increases, alternatively, when the speed of the vehicle system 102 decreases the operation threshold of the corresponding sensor 222 acquiring characteristics corresponding to the oil pressure decreases.

In operation, the controller circuit 202 may compare one or more electrical characteristics of the acquired sensor measurement signals with corresponding operational threshold(s). For example, the controller circuit 202 may compare an amplitude of the sensor measurement signal received from the water inlet temperature sensor with the corresponding operational threshold stored on the memory 212.

At 406, the controller circuit 202 may determine whether a fault/error is detected based on the characteristic data. A detected fault/error for the one or more sensors 222 may correspond to electrical characteristics of the sensor measurement signals generated by one of the one or more sensor 222 outside, above, below, or not within the one or more operational thresholds. Optionally, the controller circuit 202 may detect a fault/error when comparing the electrical characteristic(s) of the sensor measurement signal with the one or more operational thresholds. For example, the one or more sensors 222 may include a water outlet temperature sensor, which measure a temperature of the water outlet of the engine control subsystem 208. The water outlet temperature sensor may have an operational threshold of 0.5 volts to 4.5 volts. For example, during operation of the engine control subsystem 208 the water outlet temperature sensor may be configured to generate a sensor measurement signal ranging from 0.5 volts to 4.5 volts. The water outlet temperature sensor may generate a sensor measurement signal having a voltage of 6 volts. The controller circuit 202 may determines that since the sensor measurement signal of 6 volts is not within the operational threshold of 0.5-4.5 volts, a fault/error is detected for the corresponding water outlet temperature sensor. Optionally, the fault/error is detected based on a temporal component. For example, the controller circuit 202 detects a fault/error when the characteristic data is outside, above, below, or not within the one or more operational thresholds for a predetermined amount of time. The predetermine amount of time may be based on the sensor 222, corresponding operational threshold, component measured by the sensor 222, and/or the like.

If the controller circuit 202 detects a fault/error, at 408, the controller circuit 202 may add the detected fault(s)/error(s) to a fault database. Optionally, the fault data base may be stored on the memory 212. The fault database may be a collection of select sensors from the one or more sensors 222 of the propulsion-generating vehicle 200 with corresponding electrical characteristic data determined by the controller circuit 202 to be a fault/error. For example, the fault database may be a set of candidate sensors, a description of the component measured by each candidate sensor, a part number corresponding to each of the candidate sensors, one or more electrical characteristics (e.g., voltage, current, frequency, and/or the like) of the sensor measurement signal, and/or the like.

Additionally or alternatively, the controller circuit 202 may transmit the fault database to a remote system (e.g., dispatch station, repair facility, inspection center) along a communication link established by the communication circuit 210. For example, the controller circuit 202 may automatically communicate the fault database that includes the detected fault(s)/error(s) by the controller circuit 202 to a dispatch station via the communication link. Optionally, the controller circuit 202 may automatically include an inspection request with the fault database. For example, the controller circuit 202 may automatically schedule an inspection for the set of candidate sensors having the corresponding faults/errors when detected by the controller circuit 202.

At 410, the controller circuit 202 may display fault indicator(s) on a CFD based on the fault database. For example, the fault indicator(s) may correspond to one of the warning indicators 324 shown in FIG. 3. Optionally, the controller circuit 202 may generate a pop-up window with indicia (e.g., textual information, graphical information) configured to alert the operator that fault(s)/error(s) have been detected. Additionally or alternatively, in connection with FIG. 5, the operator may access a fault notification screen 501 that displays the candidate sensors having a detected fault/error.

Figure 5:
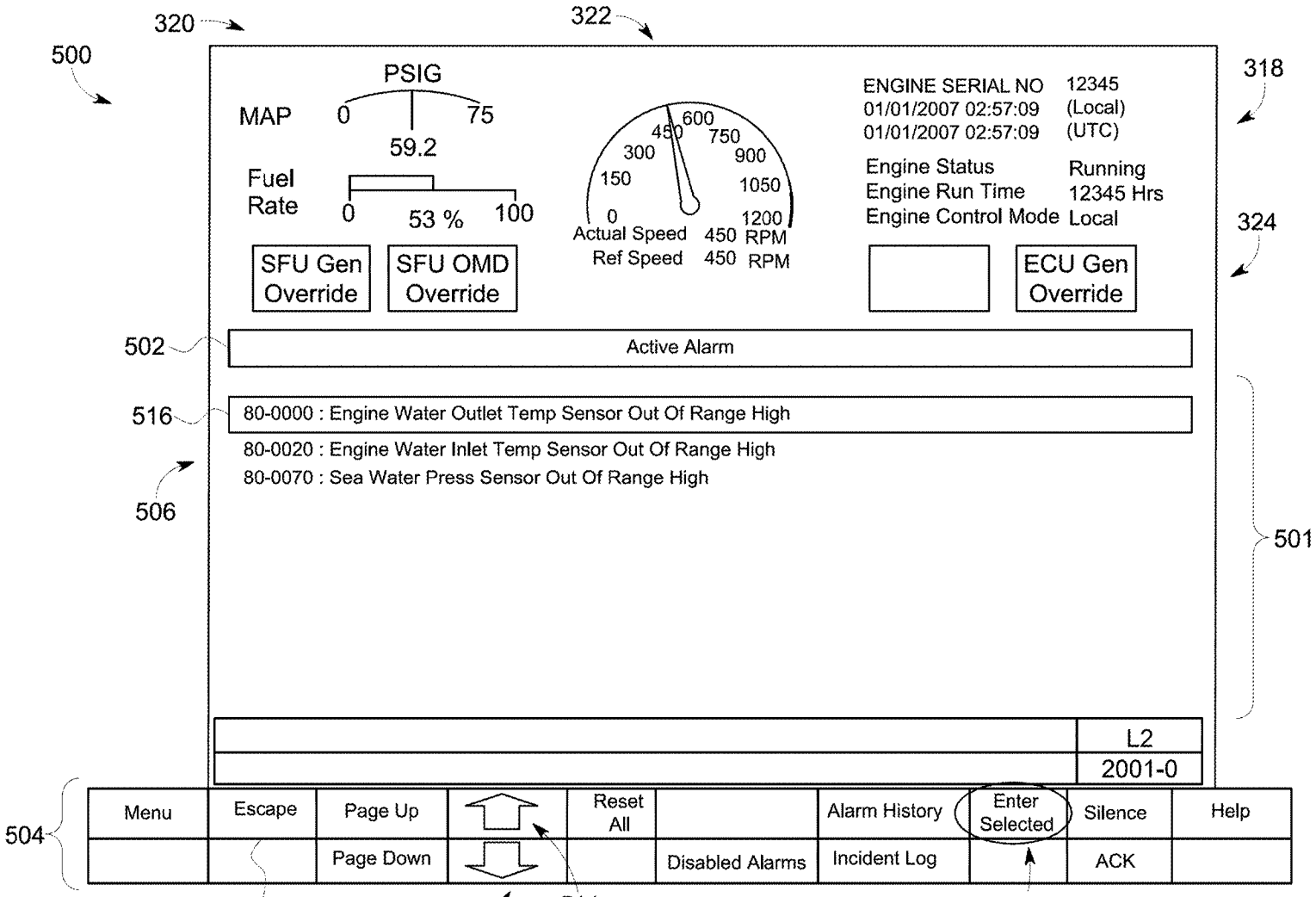
FIG. 5 is an illustration of a fault notification screen of a computational functional display shown on a display of the propulsion-generating vehicle in FIG. 2.

FIG. 5 is an illustration of the fault notification screen 501 of a CFD 500 shown on the display 206 of the propulsion-generating vehicle 200. The fault notification screen 501 may be accessed by the operator by selecting one or more interface components. For example, the operator may select the interface component 306. When the interface component 306 is selected, the controller circuit may adjust the indicator region 302 to include the fault notification screen 501. For example, the controller circuit 202 may replace the windows 312-316 with the fault notification screen 501.

The fault notification screen 501 may include a title bar 502 and a detected fault/error window 506. The title bar 502 may indicate a navigational description of the information illustrated in the CFD 500 shown on the display 206. For example, the title bar 502 may include textual, numerical, and/or graphical information to indicate that the fault notification screen 501 is being displayed on the CFD 500 and/or display 206.

The detected fault/error window 506 may list and/or provide indicia of the candidate sensors with one or more electrical characteristics of the sensor measurement signal determined by the controller circuit 202 to have a fault/error. Optionally, the detected fault/error window 506 may display information stored on the fault database stored in the memory 212. The detected fault/error window 506 may include textual, numerical, and/or graphical information corresponding to each of the candidate sensors. For example, the detected fault/error window 502 shown in FIG. 5 includes textual information describing the corresponding candidate sensor. Additionally or alternatively, the detected fault/error window 506 may include a description on the determination of the fault/error corresponding to the candidate sensors such as a position of a select electrical characteristic of the sensor measurement signal relative to the operational threshold. For example, as shown in FIG. 5, shown concurrently with the Water Outlet Temperature Sensor, the controller circuit 202 may include an "Out of Range High" indicating that a select electrical characteristic of the sensor measurement signal is high and/or above the operational threshold of to the Water Outlet Temperature Sensor.

At 411 the controller circuit 202 may determine whether one of the fault indicators corresponding to a candidate sensor is selected from the input device 204. In operation, the operator may select one or more of the candidate sensors displayed in the detected fault/error window 506, for example by selecting one or more of the interface components of an operation menu 504. The operation menu 504 may be similar to the operation menu 304 shown in FIG. 3. The operation menu 504 may include one or more interface components (e.g., 510-514) that may be selected, manipulated, and/or activated by the operator operating the input device 204 (e.g., touch screen, keyboard, mouse). For example, the operator by operating the input device 204 may select the interface component 514 to exit and/or return to a previous screen such as the CFD 300 (shown in FIG. 3).

The operation menu 504 may include interface components 510-511 that control a position of a cursor 516. The cursor 516 may be a graphic for accentuating and/or highlighting one of the candidate sensors within the fault/error window 506. The cursor 516 indicates which one of the candidate sensors is selected by the operator for the fault analysis (e.g., a select candidate sensor). The operator may move the cursor 516 by selecting one of the interface components 510-511. The interface components 510-511 each include a graphical arrow indicating a direction the cursor 516 may move when the corresponding interface component 510-511 is selected. For example, the operator may move the cursor 516 up or down the list of the set of candidate sensors each by selecting the interface components 511 and 510, respectively. The controller circuit 202 may determine that one or more highlighted candidate sensors by the cursor 516, each corresponding to fault indicator, is selected when the interface component 512 is selected and/or activated by the operator using the input device 204.

Figure 6:
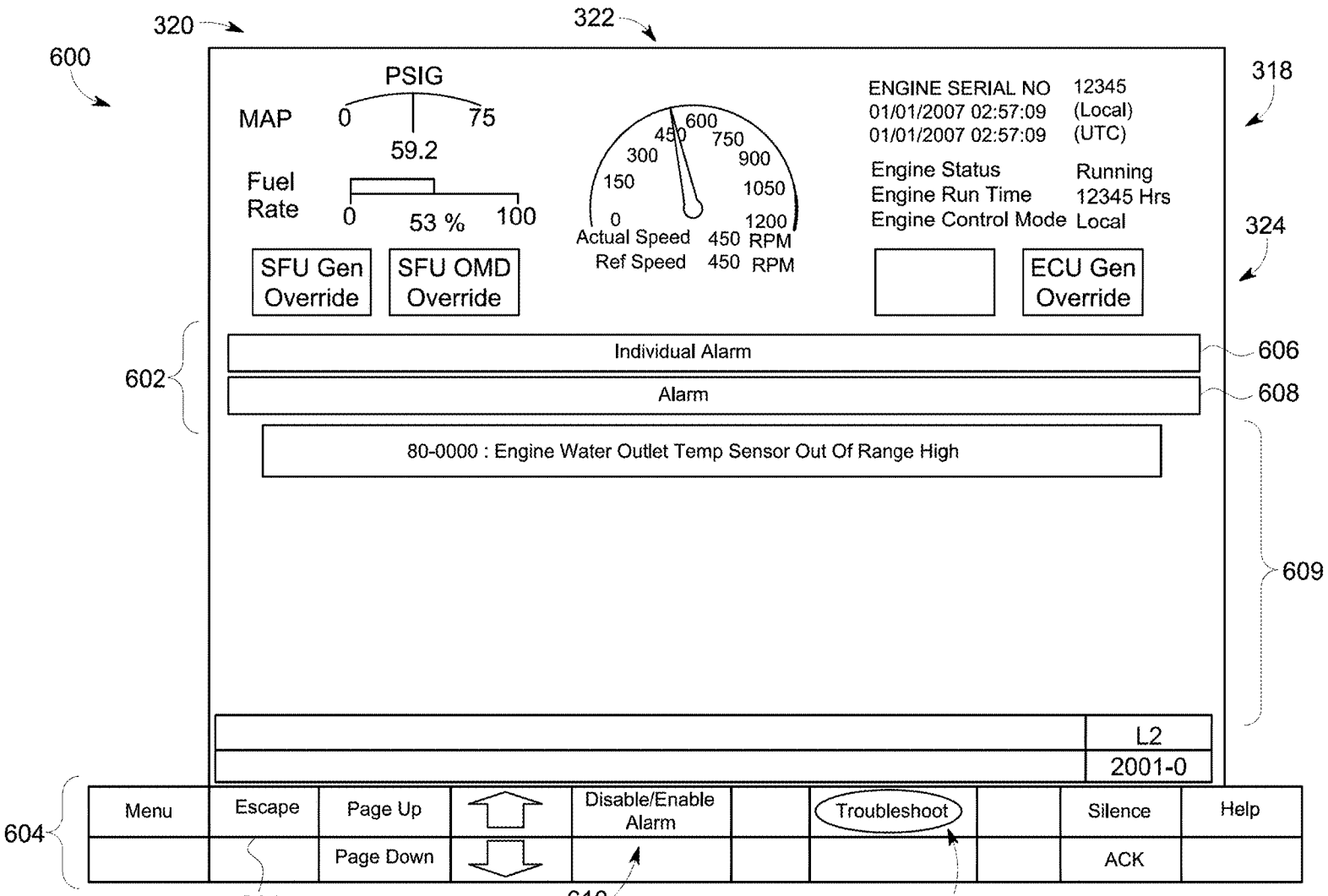
FIG. 6 is an illustration of a select fault screen of a computational functional display shown on a display of the propulsion-generating vehicle in FIG. 2.

At 412, the controller circuit 412 may display a select fault screen of the selected candidate sensor. FIG. 6 is an illustration of the selected fault screen of a CFD 600 shown on the display 206 of the propulsion-generating vehicle 200. The selected fault screen may be accessed by the operator when at least one of the candidate sensors are selected by the interface component 512 of FIG. 5. For example, the operator may move the cursor to highlight one of the candidate sensors and select the interface component 512. When the interface component 512 is selected, the controller circuit 202 may replace the fault notification screen 501 with the title bar 602 and an information window 609 of the candidate sensor(s) selected at 411. The information window 609 may include textual, numerical, and/or graphical information corresponding to the selected candidate sensor at 411.

The title bars 602 may include a description of the one or more selected candidate sensors with a corresponding fault/error that was selected by the operator. The title bars 602 may include textual, numerical, and/or graphical information. For example, the title bar 602 may include a navigational description 608 (e.g., relating to a fault/error) of the information illustrated in the CFD 600 shown on the display 206. In another example, the title bars 602 may include a numeral description 606 on a number or count of faults/alarms displayed on the CFD 600.

At 413, the controller circuit 202 may determine whether a request for a fault analysis is received from the input device 204. Additionally or alternatively, at 414 the controller circuit 202 may determine whether a ignore request is received from the input device 204. The fault analysis may include information on the fault/error corresponding to the selected candidate sensor, conditions under which the fault/error will be cleared, locations of the selected candidate sensor detecting the fault, instructions on how the operator may troubleshoot the fault, and/or the like. The ignore request may instruct the controller circuit 202 to disregard the fault/error and/or not to determine whether the sensor measurement signal generated by the selected candidate sensor is outside and/or within the operational threshold.

In connection with FIG. 6, the fault analysis request and/or ignore request may be received by the controller circuit 202 when the operator selects one or more interface components (e.g., 610, 612) of an operation menu 604. The operation menu 604 may be similar to the operation menu 304 shown in FIG. 3. The operation menu 604 may include one or more interface components (e.g., 610-614) that may be selected, manipulated, and/or activated by the operator using the input device 204 (e.g., touch screen, keyboard, mouse). For example, the operator by operating the input device 204 may select the interface component 614 to exit and/or return to a previous screen such as the CFD 500 (shown in FIG. 5).

The operation menu 604 may include interface components 610-612. Each interface component 610-612 may correspond to a particular request. For example, the controller circuit 202 may determine that a fault/analysis request is received when the interface component 612 is selected and/or activated by the operator using the input device 204. If the fault analysis is received by the controller circuit 202, at 416, the controller circuit 202 may retrieve troubleshoot information based on the fault database.

Figure 7:
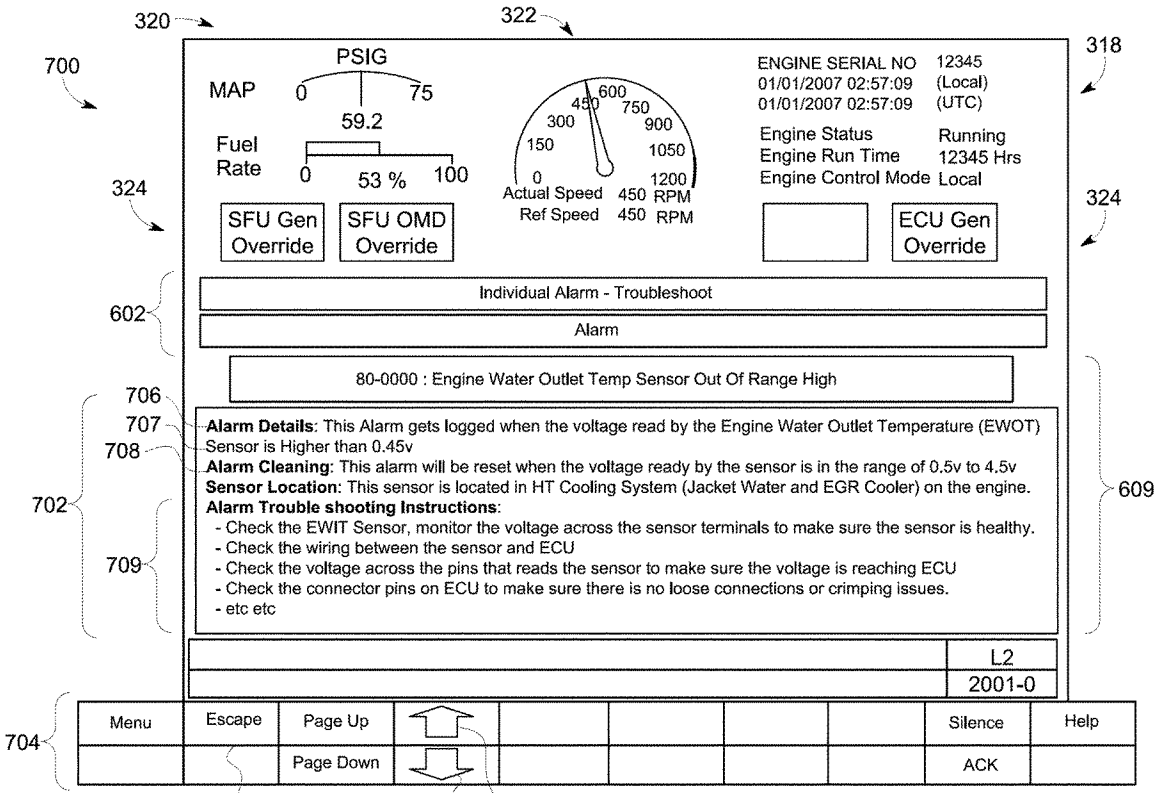
FIG. 7 is an illustration of a fault analysis and troubleshoot instructions of a computational functional display shown on a display of the propulsion-generating vehicle in FIG. 2.

FIG. 7 illustrates fault analysis and troubleshoot instructions of a CFD 700 shown on the display 206 of the propulsion-generating vehicle 200. The fault analysis and troubleshoot instructions may be shown in a troubleshoot window 702. For example, when the interface component 610 is selected, the controller circuit 202 may adjust the information window 609 to include the troubleshoot window 702. The troubleshoot window 702 may include information and/or details on a cause for the fault/error being triggered, where the selected candidate sensor corresponding to the fault/error is located, how to troubleshoot and clear the fault/error, and/or the like. Additionally or alternatively, the troubleshoot information may include information or guidelines on actions to be taken or performed by the operator to protect the components of the engine control subsystem 208. For example, the actions may reduce or shield the operational life span of the components of the engine controls subsystem 208 relative to not performing the actions within the troubleshoot information. The information and details within the troubleshoot window 702 may be stored in the memory 212. For example, each of the one or more sensors 222 may have corresponding troubleshoot information stored in a troubleshoot database in the memory 212. Optionally, the troubleshoot information may be unique for each of the one or more sensors 222. The controller circuit 202 may identify the candidate sensor displayed within the information window 609 on the troubleshoot database and retrieve the corresponding troubleshoot information for the troubleshoot window 702.

The troubleshoot window 702 may include details of the fault/error, such as alarm details 706 that provide information on the determination by the controller circuit 202 for the fault/error. The alarm details 706 may include a description on the determination of the fault/error corresponding to the selected candidate sensor such as a position of the sensor measurement signal generated by the selected candidate sensor relative to the operational threshold. For example, as shown in FIG. 7, the alarm details 706 may include information that the sensor measurement signal was higher than the operational threshold of 4.5 volts for the Water Outlet Temperature Sensor.

The troubleshoot window 702 may include information to clearing the fault, such as clearing alarm details 707. The clearing alarm details 707 may include information on the electrical characteristic of the sensor measurement signal and the operational threshold for the selected candidate alarm shown in the information window 609. For example, the clearing alarm details 707 may include delta information. The delta information may correspond to an amount the electrical characteristic of the sensor measurement signal will need to be adjusted to be within the operational threshold of the selected candidate sensor.

The troubleshoot window 702 may include sensor location 708. For example, the sensor location 708 may include information on the one or more components of the engine control subsystem 208 corresponding to and/or being measured by the selected candidate sensor. Optionally, the sensor location 708 may include a graphical illustration of the propulsion-generating vehicle 200 showing a position and/or location of the selected candidate sensor within the propulsion-generating vehicle 200 and/or the engine control subsystem 208.

The troubleshoot window 702 may include alarm troubleshooting instructions 709. The alarm troubleshooting instructions 709 may include actions that can be taken by the operator based on the fault and/or error detected by the controller circuit 202. The alarm troubleshooting instructions 709 may generally include instructions to adjust the structural (e.g., connector pins of the sensor, terminals, wiring or electrical coupling) and/or electrical properties (e.g., electrical potential across the sensor terminals) of the selected candidate sensors shown in the information window 609. For example, the troubleshooting instructions 709 may adjust the physical and/or electrical properties of the selected candidate sensor that may affect the sensor measurement signal resulting in the fault/error.

In operation, the alarm troubleshooting instructions 709 may include step by step instructions that the operator may perform to the selected candidate sensor shown in the information window 609. For example, the alarm troubleshooting instructions 709 may include a list of actions to be performed by the operator. The list of actions may include actions to measure the selected candidate sensor manually by the operator. For example, the list of actions may include measuring an electrical potential across the selected candidate sensor. Optionally, the list of action may include checking the wirings (e.g., electrical coupling), electrical potentials, and/or connections of the selected candidate sensor and the engine control subsystem 208.

Additionally or alternatively, the CFD 700 may include an operation menu 704. The operation menu 704 may be similar to the operation menu 304 shown in FIG. 3. The operation menu 704 may include one or more interface components (e.g., 710-714) that may be selected, manipulated, and/or activated by the operator operating the input device 204 (e.g., touch screen, keyboard, mouse). For example, the operator using the input device 204 may select the interface component 714 to exit and/or return to a previous screen such as the CFD 300 (shown in FIG. 3). In another example, the operation menu 704 may include interface components 710-711 that navigate and/or scroll the information displayed within the troubleshoot window 702. For example, the troubleshoot window 702 may include information not shown on the display 206 based on a size of the troubleshoot window 702. The operator may view additional information not shown within the troubleshoot window 702 by scrolling the information shown in the troubleshooting window 702, and replacing a portion of the information with the additional information not displayed. The interface components 710-711 each may include a graphical arrow indicating a direction for scrolling and/or moving the displayed information based on the selection and/or activation of the interface component 710-711 by the operator.

Returning to FIG. 6, the controller circuit 202 may determine that a ignore request is received when the interface component 610 is selected by the operator using the input device 204. If the ignore request is received, at 418, the controller circuit 202 may ignore the fault/error corresponding to the indicated sensor(s). For example, the controller circuit 202 may disregard and/or ignore the sensor measurement signal generated by the select sensor shown in the information window 609.

Returning to FIG. 2, the propulsion-generating vehicle 200 may include a vehicle control system (VCS) 218. The VCS 218 may include hardware circuits or circuitry that include and/or are connected with one or more processors. The VCS 218 can control or limit movement of the propulsion-generating vehicle 200 and/or the vehicle system 102 that includes the vehicle 200 based on one or more limitations. For example, the VCS 218 can prevent the vehicle 200 and/or vehicle system 102 from entering into a restricted area, can prevent the vehicle 200 and/or vehicle system 102 from exiting a designated area, can prevent the vehicle 200 and/or vehicle system 102 from traveling at a speed that exceeds an upper speed limit, can prevent the vehicle 200 and/or vehicle system 102 from traveling at a speed that is less than a lower speed limit, or the like. In one embodiment, the VCS 218 includes or represents a positive train control system. The VCS 218 may be programmed or otherwise have access to the vehicle identifiers of the vehicles included in the vehicle system 102 that includes the vehicle 200. For example, the VCS 218 may store right access to the vehicle identifiers so that the VCS 218 can determine how to control or limit control of the vehicle 400 and/or the vehicle system 102 that includes the vehicle 200 in order to prevent the vehicle 200 and/or vehicle system 102 from violating one or more of the limits.

The energy management system 220 can include hardware circuits or circuitry that include and and/or are connected with one or more processors. The energy management system 220 can create a trip plans for trips of the vehicle 200 and/or the vehicle system 102 that includes the vehicle 200. A trip plan may designate operational settings of the vehicle 200 and/or the vehicle system 102 as a function of time and/or distance along a route for a trip. Traveling according to the operational settings designated by the trip plan can reduce fuel consumed and/or emissions generated by the vehicle 200 and/or the vehicle system 102 relative to the vehicle 200 and/or vehicle system 102 traveling according to other operational settings that are not designated by the trip plan. The energy management system 220 may be programmed with or otherwise have access to the vehicle identifiers of the vehicles 104-108 included in the vehicle system 102. The identities of the vehicles 104-108 in the vehicle system 102 may be known to energy management system 220 so that the energy management system 220 can determine what operational settings to designate for a trip plan in order to achieve a goal of reducing fuel consumed and/or emissions generated by the consists during the trip.

FIG. 8 is a schematic diagram of a vehicle system 800 in accordance with an embodiment. For example, the vehicle system 800 is shown as a marine vessel (e.g., a ship), configured to operation in a body of water 801. The vehicle system 800 includes a controller circuit 802 that controls operations of the vehicle 800. The controller circuit 802 may be similar to and/or the same as the controller circuit 202. The controller circuit 802 may include or represent one or more hardware circuits or circuitry that include, are connected with, or that both include and are connected with one or more processors, controllers, or other hardware logic-based devices.

The controller circuit 802 may be operatively coupled to memory 812. The memory 812 may be may be used for storing data associated with one or more sensors 822 (e.g., operational threshold values, location information), fault information (e.g., when a fault was identified, conditions and/or reason for the fault), troubleshoot information corresponding to one or more faults, firmware or software corresponding to, for example, a graphical user interface, programmed instructions for one or more components in the vehicle system 800 (e.g., the controller circuit 802, the engine control subsystem 808, and/or the like). The memory 1812 may be a tangible and non-transitory computer readable medium such as flash memory, RAM, ROM, EEPROM, and/or the like.

The controller circuit 802 is connected with an engine control subsystem 808. The engine control subsystem 808 may similar to and/or the same as the engine control subsystem 208. The engine control subsystem 808 may be mechanically coupled to a propeller 807 such that it is turned by the engine control subsystem 808. For example, the engine control subsystem 808 provides propulsion to the vehicle system 800. The engine control subsystem 808 may include or represent one or more engines, motors, alternators, generators, brakes, batteries, turbines, and/or the like, that operate to propel the vehicle system 800 under the manual or autonomous control that is implemented by the controller circuit 802. For example, the controller circuit 802 can generate control signals autonomously or based on manual input that is used to direct operations of the engine control subsystem 808.

The controller circuit 802 is connected to one or more sensors 822. The one or more sensor 822 may be similar to and/or the same as the one or more sensors 222. The one or more sensors 822 may monitor one or more components of the engine control subsystem 808 by acquiring characteristic data (e.g., temperature data, humidity data, pressure data, volume data, oxidation data) of the components during operation of the vehicle system 800. Optionally, the one or more sensors 822 may be a part of the engine control subsystem 808. Additionally or alternatively, the one or more sensors 822 may be electrical coupled to one or more components of the engine control subsystem 808. The components of the engine control subsystem 808 may include a radiator, coolant, fuel tank, exhaust, intake, shaft, axle, air pump, fuel pump, water pump, pipe, and/or the like. The one or more sensors 822 may include pressure sensors (e.g., sea water pressure sensor), ultrasonic sensors, humidity sensors, magnetic sensors (e.g., hall effect sensors), speed sensors, gas sensors (e.g., oxygen sensor), temperature sensors (e.g., water temperature inlet/outlet sensor, engine coolant sensor, radiator temperature sensor), and/or the like. Each of the one or more sensors 222 may generate a sensor measurement signal, which is received and/or acquired by the controller circuit 802.

The controller circuit 802 is connected to an input device 804 and a display 806. The input device 804 and the display 806 may be similar to and/or the same as the input device 204 and the display 206, respectively. The controller circuit 802 can receive manual input from an operator of the vehicle system 800 through the input device 804, such as a keyboard, touchscreen, electronic mouse, microphone, or the like. For example, the controller circuit 802 can receive manually input changes to the tractive effort, braking effort, speed, power output, and the like, from the input device 804.

The display 806 may include one or more liquid crystal displays (e.g., light emitting diode (LED) backlight), organic light emitting diode (OLED) displays, plasma displays, CRT displays, and/or the like. For example, the controller circuit 802 can present the status and/or details of the vehicle system 800, faults/alarms based on the sensor measurement signals generated by the one or more sensors 822, and/or the like. Optionally, the display 804 may be a touchscreen display, which includes at least a portion of the input device 804. Additionally, a portion of the input device 804 may interact with a graphical user interface (GUI) generated by the controller circuit 802, such as the CFD 300, 500, 600, 700, and/or the like.

In one embodiment a system (e.g., vehicle system 100, vehicle system 800, generator system, stationary power control system) is provided. The system includes one or more sensors configured to generate sensor measurement signals based on characteristics of one or more components of an engine control subsystem. The system includes a controller circuit. The controller circuit includes one or more processors. The controller circuit is programmed to perform operations in response to instructions stored on a non-transitory memory. The operations performed by the controller circuit include acquiring the sensor measurement signals from the one or more sensors. The sensor measurement signals include electrical characteristics. The operations performed include comparing the electrical characteristics of the sensor measurement signals with operational threshold corresponding to the one or more sensors, determining a set of candidate sensors having a fault based on the sensor measurement signals as compared with the operational thresholds, and displaying a troubleshoot window based on a select candidate sensor of the set of candidate sensors.

Optionally, the system may include a communication circuit that establishes a communication link with a remote system. The controller circuit may be further programmed to schedule an inspection with the remote system for the set of candidate sensors.

Optionally, the system may include an input device that receive selections from an operator. The controller circuit may further be programmed to receive a selection of the select candidate sensor from the input device.

Optionally, the troubleshoot window may include instructions to adjust at least one of a structure or electrical property of the select candidate sensor.

Optionally, the troubleshoot window may include at least one of a location of the select candidate sensor within a propulsion-generating vehicle or the electrical characteristic of the sensor measurement signal generated by the select candidate sensor relative to the operational threshold.

Optionally, the controller circuit may be configured to adjust at least one operational threshold based on a characteristic of the one or more components.

Optionally, the electrical characteristics may include at least one of an amplitude, a voltage, a current, or a frequency.

Optionally, the display may be configured to show a computational functional display that includes troubleshoot information based on the fault of the select candidate sensor.

In one embodiment a method (e.g., for displaying a fault analysis) is provided. The method includes acquiring sensor measurement signals generated from one or more sensors associated with one or more components of an engine control subsystem. The characteristic data is based on a plurality of sensor measurement signals generated from one or more sensors. The method includes comparing electrical characteristics of the sensor measurement signals with operational thresholds corresponding to the one or more sensors, determining a set of candidate sensors having a fault based on the electrical characteristics as compared with the operational thresholds, and displaying a troubleshoot window based on a select candidate sensor of the set of candidate sensors.

Optionally, the method may include scheduling an inspection for the set of candidate sensors with a remote system.

Optionally, the method may include receiving a selection of the select candidate sensor from an input device.

Optionally, the troubleshoot window may include instructions to adjust at least one of a structure or electrical property of the select candidate sensor.

Optionally, the troubleshoot window may include at least one of a location of the select candidate sensor within a propulsion-generating vehicle or the electrical characteristic of the sensor measurement signal generated by the select candidate sensor relative to the operational threshold.

Optionally, adjusting at least one of the operational thresholds based on a characteristic of the one or more components.

Optionally, the electrical characteristics may include at least one of an amplitude, a voltage, a current, or a frequency.

Optionally, troubleshooting information may be shown on a computational functional display.

In one embodiment a tangible and non-transitory computer readable medium comprising one or more computer software modules configured to direct one or more processors to acquire sensor measurement signals generated from one or more sensors associated with one or more components of an engine control subsystem. The one or more processors may further be directed to compare electrical characteristics of the sensor measurement signals with operational thresholds corresponding to the one or more sensors, determine a set of candidate sensors having a fault based on the electrical characteristics compared with the operational thresholds, and display a troubleshoot window based on a select candidate sensor of the set of candidate sensors.

Optionally, the one or more processors may further be directed to schedule an inspection for the set of candidate sensors with a remote system.

Optionally, the one or more processors may further be directed to receive a selection of the select candidate sensor from an input device.

Optionally, the troubleshoot window includes instructions to adjust at least one of a structure or electrical property of the select candidate sensor.

As used herein, the terms "module", "system," "device," or "unit," may include a hardware and/or software system and circuitry that operates to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or operations, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

one or more sensors configured to generate sensor measurement signals based on characteristics of one or more components of an engine control subsystem;

a communication circuit that is configured to establish a communication link with a remote system;

a controller circuit having one or more processors, wherein the controller circuit is programmed to perform operations in response to instructions stored on a non-transitory memory to:

acquire the sensor measurement signals from the one or more sensors, wherein the sensor measurement signals include electrical characteristics;

compare the electrical characteristics of the sensor measurement signals with operational thresholds corresponding to the one or more sensors;

determine a set of candidate sensors having a fault based on the sensor measurement signals as compared with the operational thresholds;

display a troubleshoot window based on a select candidate sensor of the set of candidate sensors, wherein the troubleshoot window includes instructions to adjust at least one of a structure or electrical property of the select candidate sensor; and automatically schedule an inspection with the remote system for the select candidate sensor having the fault.

2. The system claim 1, further comprising an input device that receives selections from an operator, wherein the controller circuit is further programmed to receive a selection of the select candidate sensor from the input device.

3. The system of claim 1, wherein the troubleshoot window includes instructions to measure an electrical potential across the select candidate sensor or check the connections of the select candidate sensor with the engine control subsystem.

4. The system of claim 1, wherein the troubleshoot window includes a location of the select candidate sensor within a propulsion-generating vehicle or the engine control subsystem.

5. The system of claim 1, wherein the controller circuit is configured to adjust at least one operational threshold based on a speed, age, temperature, or size of the one or more components.

6. The system of claim 1, wherein the electrical characteristics include at least one of an amplitude, a voltage, a current, or a frequency.

7. The system of claim 1, wherein the display is configured to show a computational functional display that includes troubleshoot information based on the fault of the select candidate sensor.

8. The system of claim 1, wherein the troubleshoot instructions includes actions to protect components of the engine control subsystem.

9. A method comprising:

acquiring sensor measurement signals generated from one or more sensors associated with one or more components of an engine control subsystem;

comparing electrical characteristics of the sensor measurement signals with operational thresholds corresponding to the one or more sensors;

determining a set of candidate sensors having a fault based on the electrical characteristics as compared with the operational thresholds;

displaying a troubleshoot window based on a select candidate sensor of the set of candidate sensors, wherein the troubleshoot window includes instructions to adjust at least one of a structure or electrical property of the select candidate sensor; and automatically scheduling an inspection for the select candidate sensor with a remote system.

10. The method of claim 9, further comprising receiving a selection of the select candidate sensor from an input device.

11. The method of claim 9, wherein the troubleshoot window includes instructions to measure an electrical potential across the select candidate sensor or check the connections of the select candidate sensor with the engine control subsystem.

12. The method of claim 9, wherein the troubleshoot window includes a location of the select candidate sensor within a propulsion-generating vehicle or the engine control subsystem.

13. The method of claim 9, further comprising adjusting at least one of the operational thresholds based on a speed, age, temperature, or size of the one or more components.

14. The method of claim 9, wherein the electrical characteristics include at least one of an amplitude, a voltage, a current, or a frequency.

15. The method of claim 9, wherein troubleshooting information is shown on a computational functional display.

16. A tangible and non-transitory computer readable medium comprising one or more computer software modules configured to direct one or more processors to:

acquire sensor measurement signals generated from one or more sensors associated with one or more components of an engine control subsystem;

compare electrical characteristics of the sensor measurement signals with operational thresholds corresponding to the one or more sensors;

determine a set of candidate sensors having a fault based on the electrical characteristics as compared with the operational thresholds;

display a troubleshoot window based on a select candidate sensor of the set of candidate sensors, wherein the troubleshoot window includes instructions to adjust at least one of a structure or electrical property of the select candidate sensor; and automatically schedule an inspection for the select candidate sensor with a remote system.

17. The tangible and non-transitory computer readable medium of claim 16, wherein the one or more processors are further directed to receive a selection of the select candidate sensor from an input device.

18. The tangible and non-transitory computer readable medium of claim 16, wherein the troubleshoot window includes instructions to measure an electrical potential across the select candidate sensor or check the connections of the select candidate sensor with the engine control subsystem.

* * * * *